US012352024B2

(12) United States Patent
Zheng et al.

(10) Patent No.: US 12,352,024 B2
(45) Date of Patent: Jul. 8, 2025

(54) FAUCET WITH INTEGRATED HANDLE

(71) Applicant: AS America, Inc., Piscataway, NJ (US)

(72) Inventors: XiaoPing Zheng, Guangzhou (CN); Xiaojing Ye, Edison, NJ (US); Changqing Li, Guangzhou (CN)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 18/219,743

(22) Filed: Jul. 10, 2023

(65) Prior Publication Data

US 2024/0011262 A1 Jan. 11, 2024

(30) Foreign Application Priority Data

Jul. 11, 2022 (WO) ..... PCT/CN2022/104910

(51) Int. Cl.
*E03C 1/04* (2006.01)

(52) U.S. Cl.
CPC ..... *E03C 1/0412* (2013.01)

(58) Field of Classification Search
CPC ..... E03C 1/0412
See application file for complete search history.

(56) References Cited

U.S. PATENT DOCUMENTS

| | | | | |
|---|---|---|---|---|
| 5,852,848 | A | 12/1998 | Spurgeon | |
| 9,062,796 | B2 | 6/2015 | Horsman et al. | |
| 10,253,484 | B2 | 4/2019 | Bares et al. | |
| 10,436,343 | B2 | 10/2019 | Crowe et al. | |
| 10,689,835 | B2 | 6/2020 | Davidson et al. | |
| 11,001,994 | B2 | 5/2021 | Rosko | |
| 11,035,485 | B2 * | 6/2021 | Lin | F16K 27/06 |
| 11,306,845 | B2 | 4/2022 | Tang et al. | |
| 2012/0055571 | A1 * | 3/2012 | Lin | E03C 1/0403 137/625.4 |
| 2013/0248005 | A1 * | 9/2013 | Pitsch | E03C 1/04 137/315.12 |
| 2020/0408313 | A1 * | 12/2020 | Allen | F16K 19/006 |

* cited by examiner

*Primary Examiner* — P. Macade Nichols
(74) *Attorney, Agent, or Firm* — Anna-Lisa L. Gallo; Tyler A. Stevenson

(57) ABSTRACT

A faucet assembly comprising a handle coupled to a cartridge stem; and an upper body portion coupled to a lower body portion, wherein the lower body portion comprises an integral waterway. A faucet assembly may comprise a single integrated handle having no set screw. A faucet assembly upper body portion may be coupled to a lower body portion with a set screw at or through an underside of the lower body portion.

20 Claims, 4 Drawing Sheets

FAUCET WITH INTEGRATED HANDLE

The application is directed to a faucet assembly, in particular, to a faucet assembly comprising an integrated handle.

BACKGROUND

Faucets, for instance monoblock faucets comprising a single handle to control water flow and temperature, comprise a handle fixed to a cartridge stem. The handle is fixed to a cartridge stem with a set screw. A set screw is typically positioned at a rear of a handle, but may still be visible, and/or may be covered by a cap or button. A set screw employed to fix a faucet handle to a cartridge stem may be under strain as it is subject to movement together with the handle and cartridge stem during use. A set screw may become loose or degrade over time. Desired is a faucet assembly having a handle fixed to a cartridge stem without a set screw. Such a faucet assembly will be more aesthetically pleasing as well as more stable.

SUMMARY

Accordingly, disclosed is a faucet assembly comprising a handle coupled to a cartridge stem; and an upper body portion coupled to a lower body portion, wherein the lower body portion comprises an integral waterway. In some embodiments, a faucet assembly comprises a single handle. In some embodiments, a present handle does not comprise a set screw and may be called an "integrated handle". In some embodiments, an upper body portion may be coupled to a lower body portion with a set screw through an underside of the lower body portion. In some embodiments, the integral waterway may comprise a curved portion.

In some embodiments, the lower body portion may comprise a protrusion, the upper body portion may comprise a threaded protrusion, the lower body portion protrusion can be configured to mate with the upper body portion protrusion, and the upper body portion threaded protrusion can be configured to receive a set screw.

In some embodiments, the integral waterway may be curved around the lower body portion protrusion.

In some embodiments, integral waterway may be coupled to a waterway adapter to provide flow communication between the waterway and a cartridge.

In some embodiments, a faucet assembly may comprise a set screw, wherein the set screw does not move during operation of the handle.

In some embodiments, the handle may be coupled to a handle cap.

In some embodiments, the handle may be coupled to a handle cap through an opening in the upper body portion.

In some embodiments, the handle cap may comprise a threaded protrusion, and wherein the handle is coupled to the handle cap via the threaded protrusion.

In some embodiments, the cartridge stem may be coupled to the handle through an opening in the handle cap.

In some embodiments, the opening in the handle cap may be positioned in a handle cap threaded protrusion.

In some embodiments, a faucet assembly may comprise a sealing ring positioned between a handle cap and the upper body portion.

In some embodiments, the sealing ring may comprise an O-ring configured to form a seal with the upper body portion.

In some embodiments, the cartridge stem may be coupled to a cartridge, and wherein the cartridge is positioned in the lower body portion.

In some embodiments, the upper body portion may be substantially flat and horizontal.

In some embodiments, the lower body portion may comprise a substantially flat, horizontal portion and a vertical portion configured to house a cartridge.

In some embodiments, the upper body portion may be substantially flat and horizontal, and may be coupled to a flat, horizontal portion of the lower body portion.

In some embodiments, the handle may be positioned at an upper surface of the upper body portion.

In some embodiments, the upper body portion and the lower body portion may comprise a metal.

In some embodiments, the sealing ring may comprise an engineering thermoplastic.

In some embodiments, the waterway adapter may comprise a thermoplastic.

In some embodiments, the handle cap may comprise a metal.

BRIEF DESCRIPTION OF THE DRAWINGS

This disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
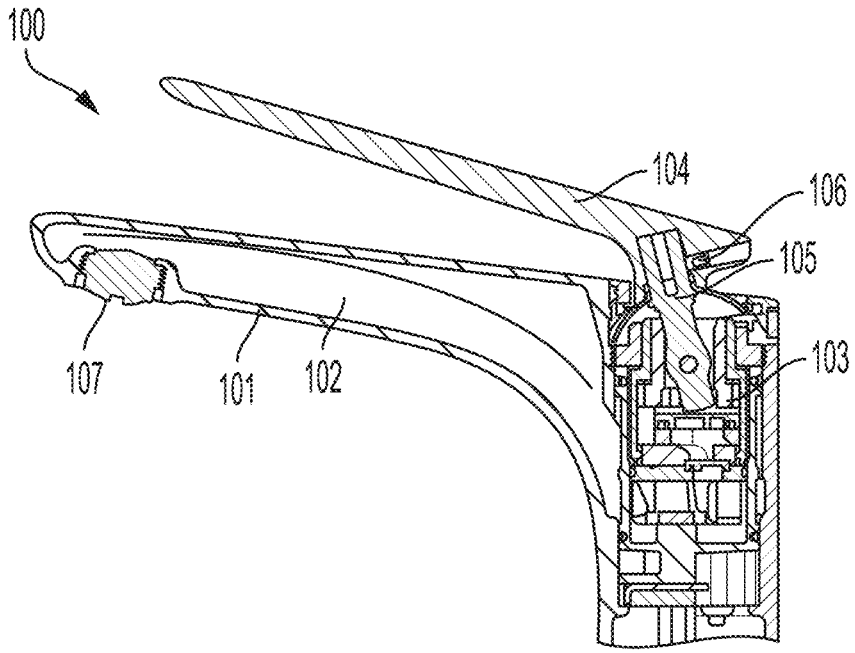
FIG. 1 shows a typical monoblock faucet in cross-section.

FIG. 1 shows monoblock faucet assembly 100, as is known in the art. Faucet 100 comprises faucet body 101, waterway 102, cartridge 103, handle 104, and cartridge stem 105. Up/down and left/right movement of handle 104 is configured to move and rotate cartridge stem 105 to control flow and temperature of water from source water, through cartridge 103, through waterway 102, and out outlet 107. Faucet assembly 100 comprises set screw 106, configured to fix handle 104 to cartridge stem 105.

Figure 2:
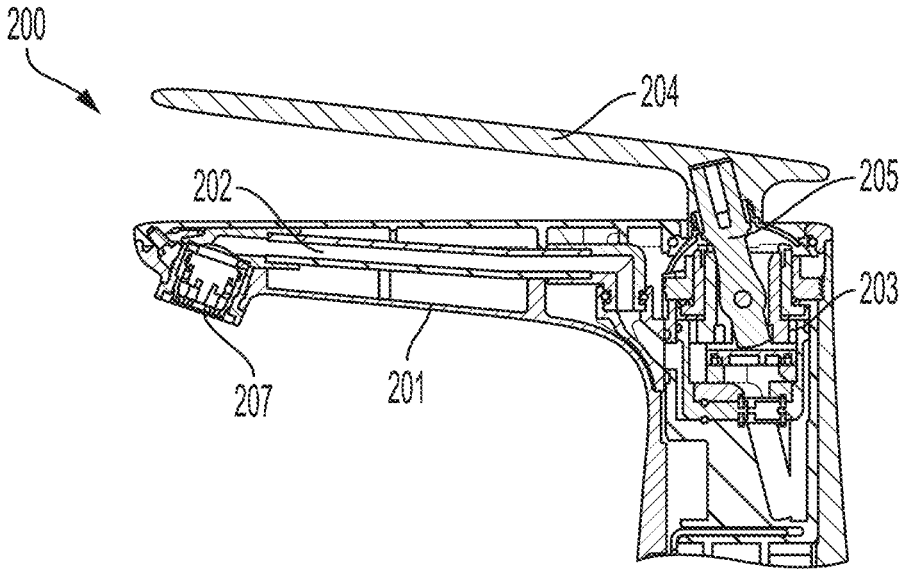
FIG. 2 shows a monoblock faucet in cross-section, according to an embodiment.

FIG. 2 shows monoblock faucet assembly 200 of the invention, according to an embodiment. Faucet assembly 200 comprises faucet body 201, waterway 202, cartridge 203, handle 204, cartridge stem 205, and faucet outlet 207. Faucet assembly 200 comprises no set screw to affix handle 204 to cartridge stem 205.

Figure 3A:
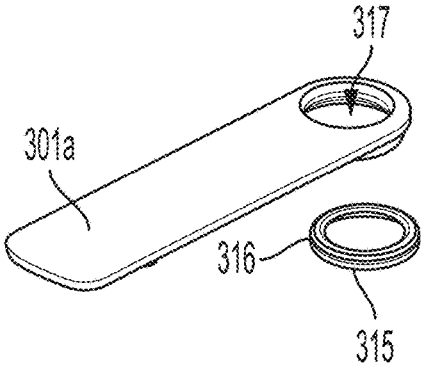
FIG. 3A, FIG. 3B, FIG. 3C, FIG. 3D, FIG. 3E, and FIG. 3F provide partial exploded views and partial views of a monoblock faucet assembly, according to some embodiments.
Figure 3B:
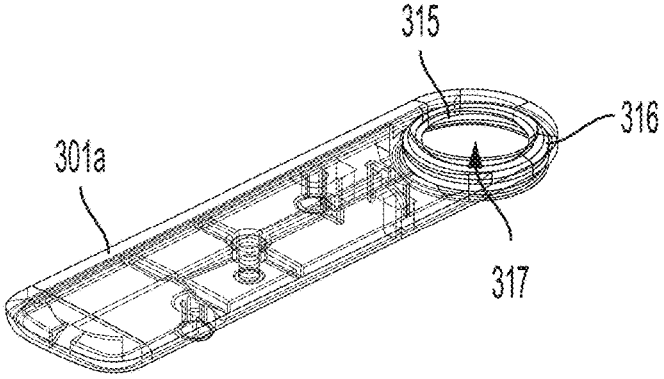
Figure 3C:
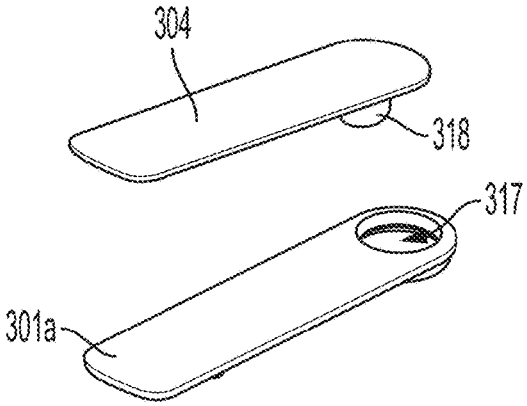

FIG. 3A provides a view of faucet body upper portion 301*a* and sealing ring 315, according to an embodiment. Sealing ring 315 comprises O-ring 316 positioned in an upper groove thereof. FIG. 3B provides a see-through bottom view of faucet body upper portion 301*a* having sealing ring 315 positioned in opening 317. FIG. 3C shows handle

Figure 3D:
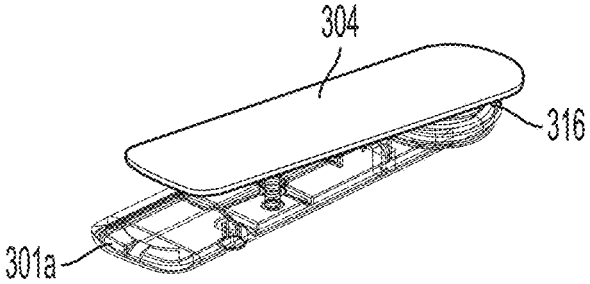

304 having annular protrusion 318 configured to be positioned in opening 317 of faucet body upper portion 301*a*. FIG. 3D shows handle 304 having annular protrusion 318 positioned in opening 317 of faucet body upper potion 301*a*. Visible is annular O-ring 316 in see-through body upper portion 301*a*.

Figure 3E:
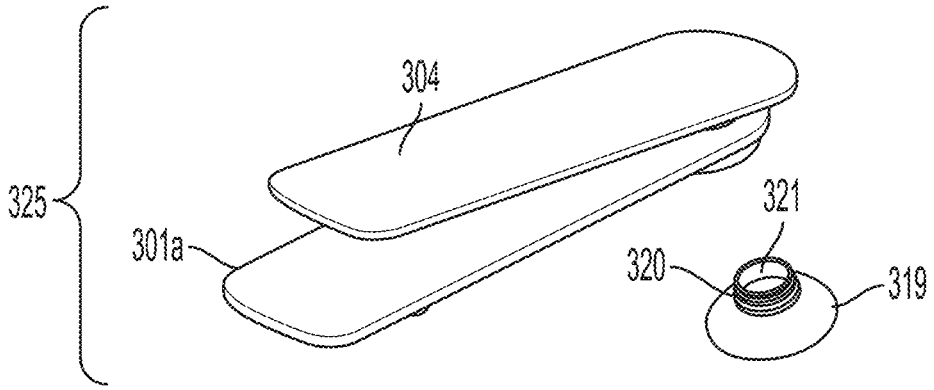
Figure 3F:
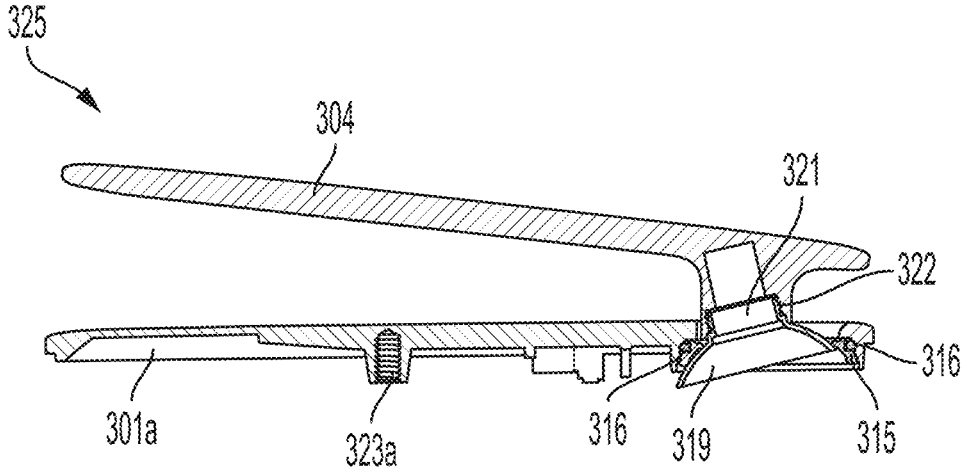

FIG. 3E shows the assembly of FIG. 3D configured to receive handle cap 319 in opening 317 (not visible). Handle cap 319 comprises upper annular protrusion 321 having outer threaded surface 320. Handle cap 319 is threaded into handle 304 to provide assembly 325, shown in cross-section in FIG. 3F. Visible in FIG. 3F are sealing ring 315 and O-ring 316 positioned in body upper portion 301*a*. Handle cap 319 is threaded into handle 304 to provide threaded connection 322. Body upper portion 301*a* contains threaded protrusion 323*a* configured to receive a set screw.

Figure 3G:
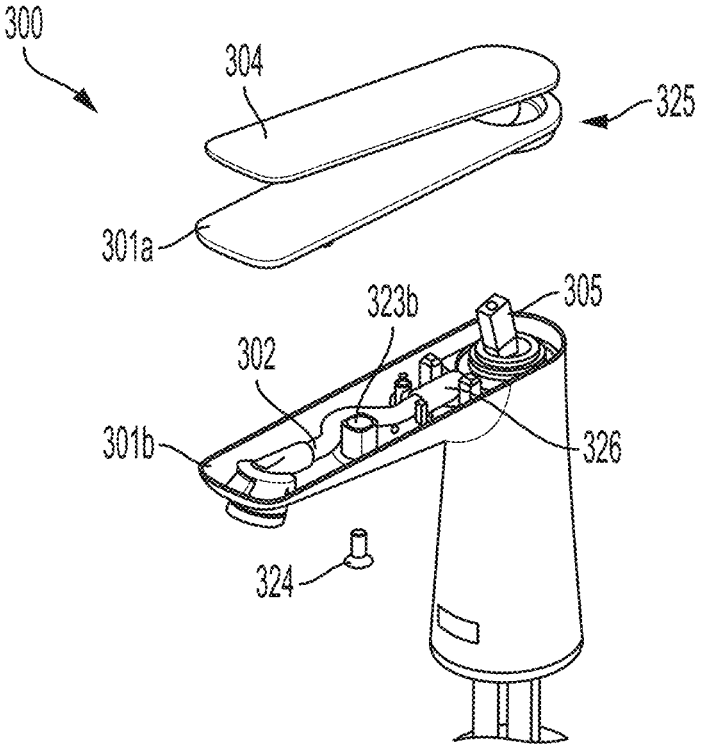
FIG. 3G provides an exploded view of a monoblock faucet assembly, according to an embodiment.

FIG. 3G provides an exploded view of monoblock faucet assembly 300, according to an embodiment. Body upper portion 301*a* is coupled to body lower portion 301*b*. An opening (not visible) in handle 304 and in handle cap (not visible) are configured to receive cartridge stem 305. Body upper portion 301*a* and body lower portion 301*b* are coupled with set screw 324. Visible is curved waterway 302. Waterway 302 is integral to body lower portion 301*b* and curves around protrusion 323*b*. Protrusion 323*b* is configured to receive threaded protrusion 323*a*.

Figure 3H:
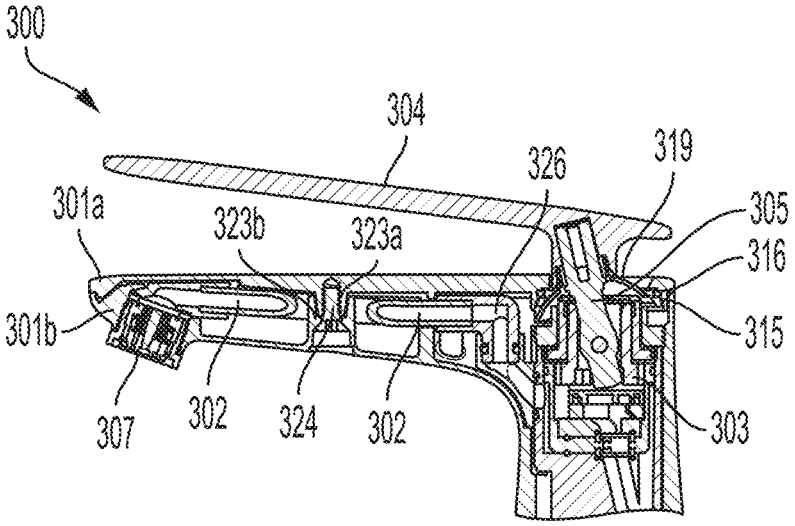
FIG. 3H provides a cross-section view of a monoblock faucet assembly, according to an embodiment.

FIG. 3H provides a cross-section view of monoblock faucet assembly 300, according to an embodiment. Visible are cartridge 303, cartridge stem 305, sealing ring 315, O-ring 316, and handle cap 319. Also visible is a coupling formed between body upper portion 301*a* and body lower portion 301*b* via threaded portion 323*a*, protrusion 323*b*, and set screw 324. Waterway 302 and outlet 307 are also visible. Waterway 302 is coupled to elbow-shaped waterway adapter 326 to provide flow communication with cartridge 303.

In some embodiments, a faucet assembly, comprises a handle coupled to a cartridge stem; and an upper body portion coupled to a lower body portion, wherein the lower body portion comprises an integral waterway. A handle may comprise a lower opening configured to receive a cartridge stem. In some embodiments, a faucet assembly may comprise only one handle. Such faucet assemblies may be called "monoblock" faucets. A single handle may be manipulated up/down and left/right to control both on/off for water flow and water temperature, respectively.

In some embodiments of the disclosure, a present handle may comprise no set screw to couple it to a cartridge stem. In some embodiment, a faucet assembly upper body portion may be coupled to a lower body portion with a set screw through/at an underside of the lower body portion. Such a set screw will not be visible and will not be subject to any movement during operation of a faucet handle.

In some embodiment, an integral waterway may comprise a curved portion. A waterway curved portion may be configured to curve around a set screw connection coupling an upper and lower body portion. A set screw connection coupling an upper and lower body portion may be substantially centered from left to right. In other embodiments, a set screw connection coupling an upper and lower body portion may be offset from left to right across a faucet body assembly.

In some embodiments, a lower body portion may comprise a protrusion, and an upper body portion may comprise a threaded protrusion, wherein the lower body portion protrusion is configured to mate with the upper body portion protrusion. In some embodiments, a lower body portion protrusion may be configured to receive an upper body portion protrusion. In some embodiments, an upper body protrusion may comprise an inner threaded surface configured to receive a set screw. In some embodiments, an integral waterway may be curved around a lower body portion protrusion.

In some embodiments, an integral waterway may be coupled to a waterway adapter configured to provide flow communication between the waterway and a cartridge. A waterway adapter may comprise a right angle.

In some embodiments, a handle may be coupled to a handle cap. A handle may be coupled to a handle cap through an opening in the upper body portion. In some embodiments, a handle cap may comprise an upper threaded protrusion, wherein the handle is coupled to the handle cap via the threaded protrusion. In some embodiments, a cartridge stem may coupled to a handle through an opening in a handle cap. In some embodiments, an opening in a handle cap may be positioned in a handle cap threaded protrusion.

In some embodiments, a faucet assembly may comprise a sealing ring positioned between a handle cap and an upper body portion. A sealing ring may comprise an annular O-ring configured to form a seal with the upper body portion. A sealing ring may comprise a groove or a notch configured to receive an O-ring. A groove or notch may be positioned towards an upper portion of a sealing ring and configured so that an O-ring may form a seal with an underside of an upper body portion A cartridge stem will be coupled to a cartridge. In some embodiments, a cartridge may be configured to be positioned in a faucet assembly lower body portion. In some embodiments, an upper body portion may be a substantially flat, horizontal piece. In some embodiments, a lower body portion may comprise a substantially flat, horizontal section configured to couple to an upper body portion. A lower body portion may also comprise a vertical portion, substantially perpendicular to a flat, horizontal portion. A lower body portion vertical portion may be configured to be positioned on a deck (e.g. a countertop), and configured to house a cartridge. In some embodiments, a handle may be positioned at an upper surface of an upper body portion, for example towards an upper surface, rear section of an upper body portion.

In some embodiments, an upper body portion and a lower body portion may comprise a metal, for instance zinc or stainless steel. In some embodiments, a waterway adapter configured to provide flow communication between the waterway and a cartridge may comprise a thermoplastic, for instance a polyolefin. Polyolefins include for example polypropylene, polyethylene, and copolymers and blends comprising polypropylene and/or polyethylene. In some embodiments, a handle cap may comprise a metal, for example brass. In some embodiments, a sealing ring may comprise an engineering thermoplastic. Engineering thermoplastics include for example polyamides, polyesters, polycarbonates, acrylonitrile-butadiene-styrene, and polyacetals.

The term "flow communication" or "fluid communication" means for example configured for liquid or gas flow therethrough and may be synonymous with "fluidly coupled". The terms "upstream" and "downstream" indicate a direction of gas or fluid flow, that is, gas or fluid will flow from upstream to downstream.

Likewise, "electrical communication" may mean "electrically coupled". Electrical communication may be via wired connection or may be wireless.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A faucet assembly, comprising
a handle coupled to a cartridge stem; and
an upper body portion coupled to a lower body portion, wherein
the lower body portion comprises an integral waterway,
the lower body portion comprises a protrusion,
the upper body portion comprises a threaded protrusion,
the lower body portion protrusion is configured to mate with the upper body portion protrusion, and
the upper body portion threaded protrusion is configured to receive a set screw.

2. The faucet assembly according to claim 1, comprising a single handle.

3. The faucet assembly according to claim 1, wherein the upper body portion is coupled to the lower body portion with the set screw at an underside of the lower body portion.

4. The faucet assembly according to claim 1, wherein the integral waterway comprises a curved portion.

5. The faucet assembly according to claim 1, wherein the upper body portion is coupled to the lower body portion with a single set screw.

6. The faucet assembly according to claim 1, wherein the integral waterway is curved around the lower body portion protrusion.

7. The faucet assembly according to claim 1, wherein the integral waterway is coupled to a waterway adapter to provide flow communication between the waterway and a cartridge.

8. The faucet assembly according to claim 1, wherein the set screw does not move during operation of the handle.

9. The faucet assembly according to claim 1, wherein the handle is coupled to a handle cap.

10. The faucet assembly according to claim 1, wherein the handle is coupled to a handle cap through an opening in the upper body portion.

11. The faucet assembly according to claim 10, wherein the handle cap comprises a threaded protrusion, and wherein the handle is coupled to the handle cap via the threaded protrusion.

12. The faucet assembly according to claim 11, wherein the cartridge stem is coupled to the handle through an opening in the handle cap.

13. The faucet assembly according to claim 12, wherein the opening in the handle cap is positioned in a handle cap threaded protrusion.

14. The faucet assembly according to claim 13, comprising a sealing ring positioned between the handle cap and the upper body portion.

15. The faucet assembly according to claim 14, wherein the sealing ring comprises an O-ring configured to form a seal with the upper body portion.

16. The faucet assembly according to claim 1, wherein the cartridge stem is coupled to a cartridge, and wherein the cartridge is positioned in the lower body portion.

17. The faucet assembly according to claim 1, wherein the upper body portion is substantially flat and horizontal.

18. The faucet assembly according to claim 1, wherein the lower body portion comprises a substantially flat, horizontal portion and a vertical portion configured to house a cartridge.

19. The faucet assembly according to claim 1, wherein the upper body portion is substantially flat and horizontal, and is coupled to a flat, horizontal portion of the lower body portion.

20. The faucet assembly according to claim 1, wherein the handle is positioned at an upper surface of the upper body portion.

* * * * *